US009709922B2

(12) United States Patent
Narita

(10) Patent No.: US 9,709,922 B2
(45) Date of Patent: Jul. 18, 2017

(54) IMAGE PROCESSING APPARATUS, INFORMATION PROCESSING METHOD, AND STORAGE MEDIUM

(71) Applicant: CANON KABUSHIKI KAISHA, Tokyo (JP)

(72) Inventor: Tateki Narita, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/705,758

(22) Filed: May 6, 2015

(65) Prior Publication Data

US 2015/0323883 A1 Nov. 12, 2015

(30) Foreign Application Priority Data

May 9, 2014 (JP) ..... 2014-097913

(51) Int. Cl.
*G03G 15/08* (2006.01)
*G03G 15/00* (2006.01)

(52) U.S. Cl.
CPC ..... *G03G 15/0856* (2013.01); *G03G 15/0831* (2013.01); *G03G 15/556* (2013.01)

(58) Field of Classification Search
CPC combination set(s) only.
See application file for complete search history.

(56) References Cited

U.S. PATENT DOCUMENTS 5,349,377 A * 9/1994 Gilliland ..... H04N 1/00002 347/131
2009/0290886 A1* 11/2009 Murauchi ..... G03G 15/0844 399/27
2011/0032548 A1* 2/2011 Nishikata ..... G03G 15/50 358/1.9
2012/0170080 A1* 7/2012 Ooyanagi ..... H04N 1/00846 358/3.28

FOREIGN PATENT DOCUMENTS

JP 2012-141497 A 7/2012

* cited by examiner

*Primary Examiner* — Clayton E Laballe
*Assistant Examiner* — Victor Verbitsky
(74) *Attorney, Agent, or Firm* — Canon USA, Inc. I.P. Division

(57) ABSTRACT

An image processing apparatus includes a generation unit configured to generate a composite image to be combined with an input image, a first calculation unit configured to perform, based on a type of the composite image, approximation calculation of a value indicating a toner amount to be used in printing the composite image generated by the generation unit, a second calculation unit configured to calculate, based on a value indicating a toner amount to be used in printing the input image and the value indicating the toner amount to be used in printing the composite image, which is obtained by approximation calculation performed by the first calculation unit, a value indicating a toner amount to be used in printing the input image combined with the composite image, and a notification unit configured to notify a printing unit of the value calculated by the second calculation unit.

16 Claims, 7 Drawing Sheets

FIG. 5

<IMAGE FILLING RATE SETTING EXAMPLES>

| TYPE OF TEXT | NOTATION OF TEXT | IMAGE FILLING RATE |
|---|---|---|
| DATE/TIME | NUMERALS | 0.16 |
| CHARACTER STRING | ALPHABET | 0.24 |
| | CHINESE CHARACTERS | 0.20 |
| | OTHER BINARY CHARACTERS | 0.15 |

IMAGE PROCESSING APPARATUS, INFORMATION PROCESSING METHOD, AND STORAGE MEDIUM

BACKGROUND OF THE INVENTION

Field of the Invention

The present invention relates to an image processing technique for raising print speed.

Description of the Related Art

An image processing apparatus which includes a print function for printing an image on paper media using toner, stores the toner in a container in a printing unit. The toner container in the printing unit is divided into two layers, i.e., a first layer storing original toner and a second layer storing toner to be used for immediate printing. The image forming apparatus performs control for replenishing the second layer with the toner from the first layer by an amount used in the second layer each time printing is performed. The image processing apparatus determines the amount of toner to replenish the second layer by calculating a video count value when generating image data to be printed. The video count value is a value indicating a toner amount to be used in printing and is defined by each pixel of the image data integrated with a density value thereof.

More specifically, the image processing apparatus performs halftone processing, i.e., converts a multi-valued image in a red, green, and blue (RGB) format input from an external device or a reading unit to a binary image for each color toner (e.g., cyan (C), magenta (M), yellow (Y), and black (K)), to generate print image data. The image processing apparatus measures the video count in halftone processing using hardware, notifies the printing unit of the video count value, and performs toner replenishment.

If the toner amount actually used is different from the toner amount replenished after printing, there is excess or deficiency in the toner amount stored in the second layer and to be used for immediate printing. In such a case, normal printing density cannot be maintained, and thus printing may result in light or excessively deep color print. In particular, an image processing apparatus in which a capacity of the second layer is small is greatly affected by such a difference. It is thus necessary for the image processing apparatus to accurately measure the video count value.

As described above, the image processing apparatus prints the print image data obtained by performing halftone processing on the data input from the external device or the reading unit. Further, the image processing apparatus includes an image combining function for combining the halftone-processed print image data with the binary image generated within the apparatus and printing the combined image.

In such a case, it is necessary to add the toner amount used for printing a composite image portion generated in the image processing apparatus, in addition to the toner amount used for printing the input image portion which has been halftone-processed, to determine the toner amount to be used. It is thus necessary to separately calculate the video count value of the composite image portion.

According to a conventional technique, chromatic color pixels and the density values thereof are analyzed using software with respect to the generated composite image and the video count value is then calculated. Further, Japanese Patent Application Laid-Open No. 2012-141497 discusses a method for calculating the video count value of an output image after performing image combination by subtracting the video count value of the composited image from the video count value of a document image.

However, according to the conventional technique, it takes time to calculate a video account value of a composite image since it is necessary to perform image analysis using software to calculate the video count value. As a result, printing time becomes longer taking time required for calculating the video count value, and performance is thus deteriorated.

SUMMARY OF THE INVENTION

According to an aspect of the present invention, an image processing apparatus includes a generation unit configured to generate a composite image to be combined with an input image, a first calculation unit configured to perform, based on a type of the composite image, approximation calculation of a value indicating a toner amount to be used in printing the composite image generated by the generation unit, a second calculation unit configured to calculate, based on a value indicating a toner amount to be used in printing the input image and the value indicating the toner amount to be used in printing the composite image, which is obtained by approximation calculation performed by the first calculation unit, a value indicating a toner amount to be used in printing the input image with which the composite image has been combined, and a notification unit configured to notify a printing unit of a value calculated by the second calculation unit.

Further features of the present invention will become apparent from the following description of exemplary embodiments with reference to the attached drawings.

BRIEF DESCRIPTION OF THE DRAWINGS

FIGS. 3A-1, 3A-2, 3B, and 3C illustrate more concrete examples of image combination.

FIG. 5 illustrates an example of setting image filling rates.

DESCRIPTION OF THE EMBODIMENTS

Exemplary embodiments according to the present invention will be described below with reference to the drawings.

Figure 1:
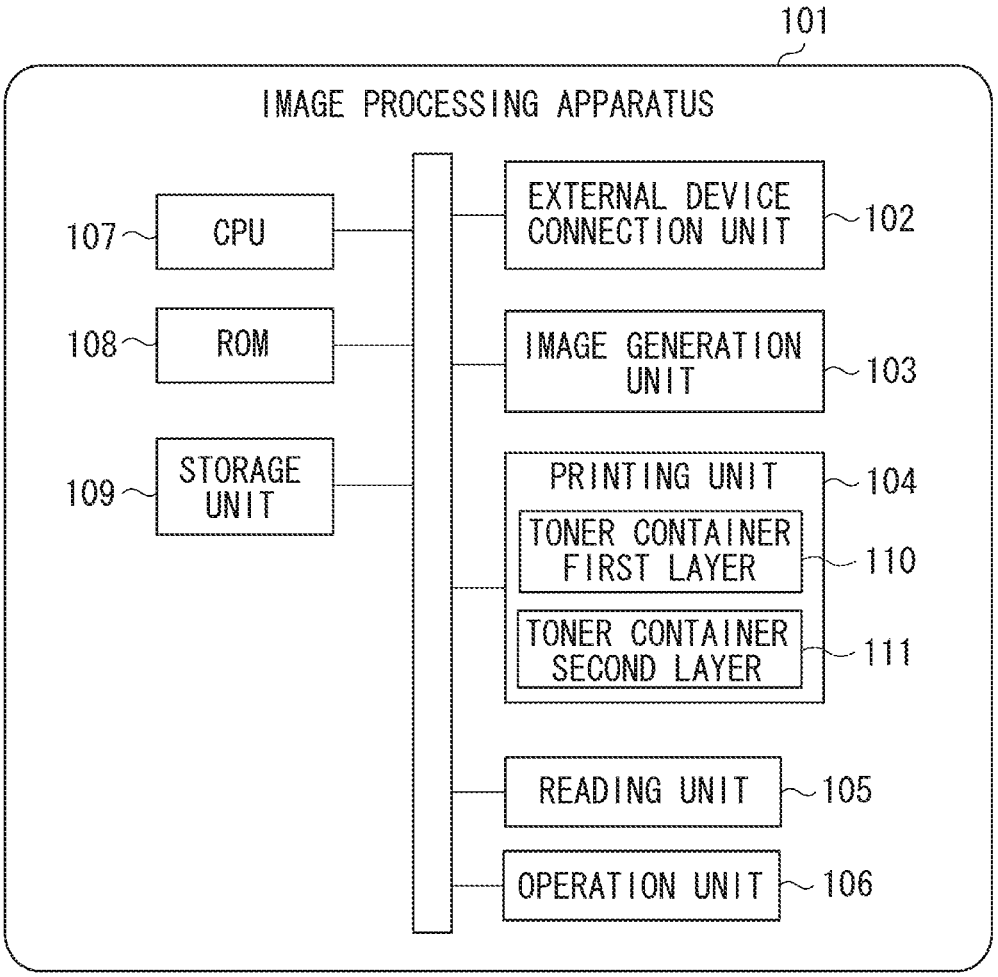
FIG. 1 illustrates an example of a hardware configuration of the image processing apparatus.

FIG. 1 illustrates an example of a hardware configuration of the image processing apparatus.

Referring to FIG. 1, an image processing apparatus 101 includes an external device connection unit 102, an image generation unit 103, a printing unit 104, a reading unit 105, an operation unit 106, a central processing unit (CPU) 107, a read-only memory (ROM) 108, and a storage unit 109.

The external device connection unit 102 communicates with an external device using a local area network (LAN) or a universal serial bus (USB) and transmits and receives image data and the like. The image generation unit 103 performs predetermined image processing such as color space conversion and density adjustment on image data obtained by the external device connection unit 102 or the reading unit 105 to generate image data. The printing unit 104 prints the image data generated by the image generation unit 103 on a paper medium. The printing unit 104 includes a toner container first layer 110 and a toner container second layer 111, which stores toner to be used for printing the image data. More specifically, the toner container first layer 110 stores original toner in the printing unit 104 and the toner container second layer 111 stores toner to be used for immediate printing. Printing toner is replenished, depending on an amount of toner used for each printing, from the toner container first layer 110 to the toner container second layer 111.

The reading unit 105 reads the image printed on the paper medium by an optical sensor and inputs the read image to the image processing apparatus 101. The image generation unit 103 performs predetermined image processing on the image data input from the reading unit 105, and the external device connection unit 102 transmits the processed image data. Alternatively, the printing unit 104 performs printing of the image data input from the reading unit 105. The operation unit 106 includes a user interface such as keys and a display panel and receives an operation request from a user.

The CPU 107 is a control unit configured to control the entire image processing apparatus. The ROM 108 is a memory for storing control programs of the CPU 107. The storage unit 109 is a volatile memory for storing image data and variables of the control programs of the CPU 107.

Figure 6:
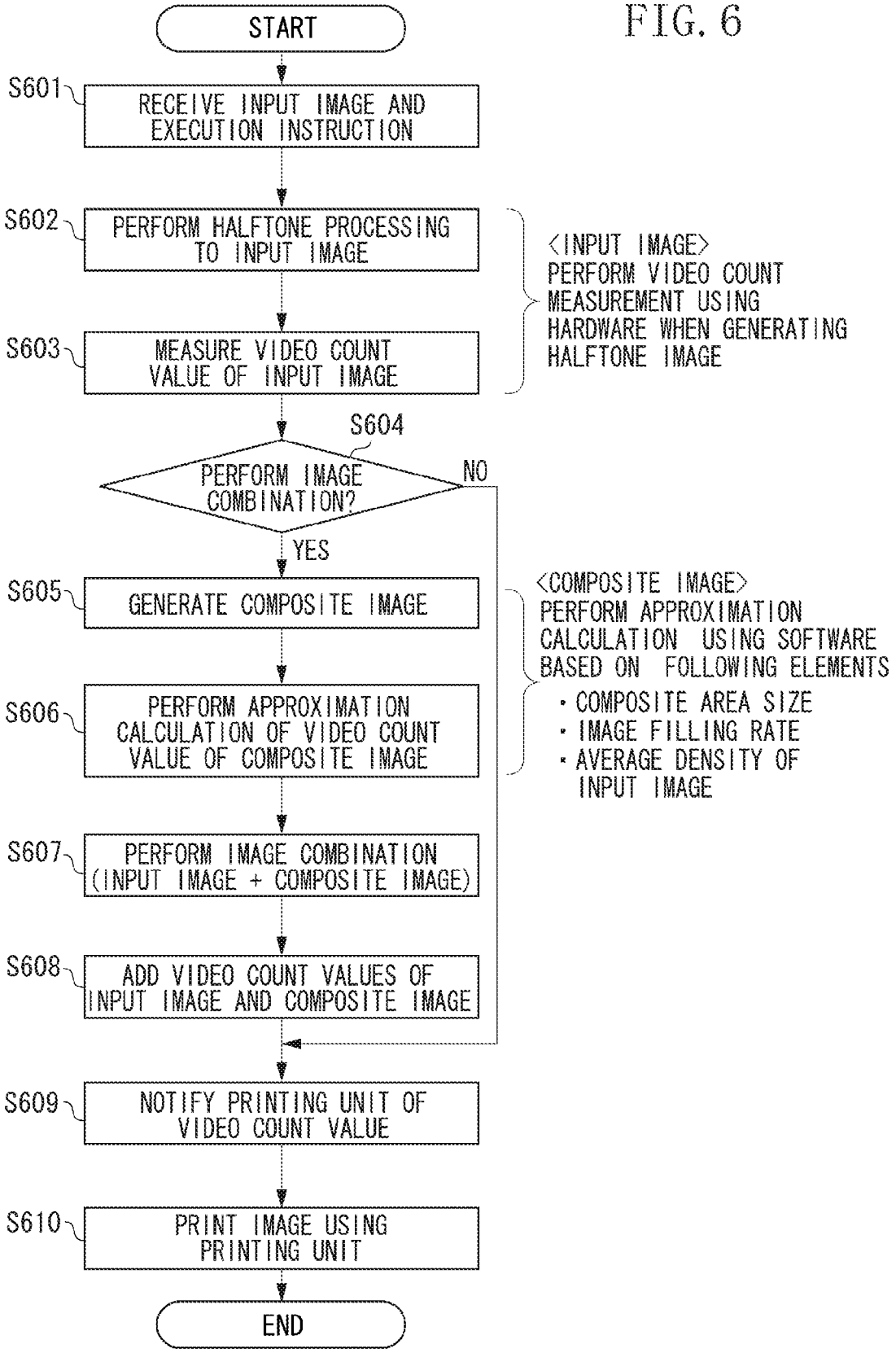
FIG. 6 is a flowchart illustrating an example of information processing performed by the image processing apparatus.

The CPU 107 executes processes based on the programs stored in the ROM 108 or the storage unit 109. As a result, the functions of the image processing apparatus 101, which relates to software, as described below and the processes performed by executing the software as illustrated in FIG. 6 are realized.

Figure 2:
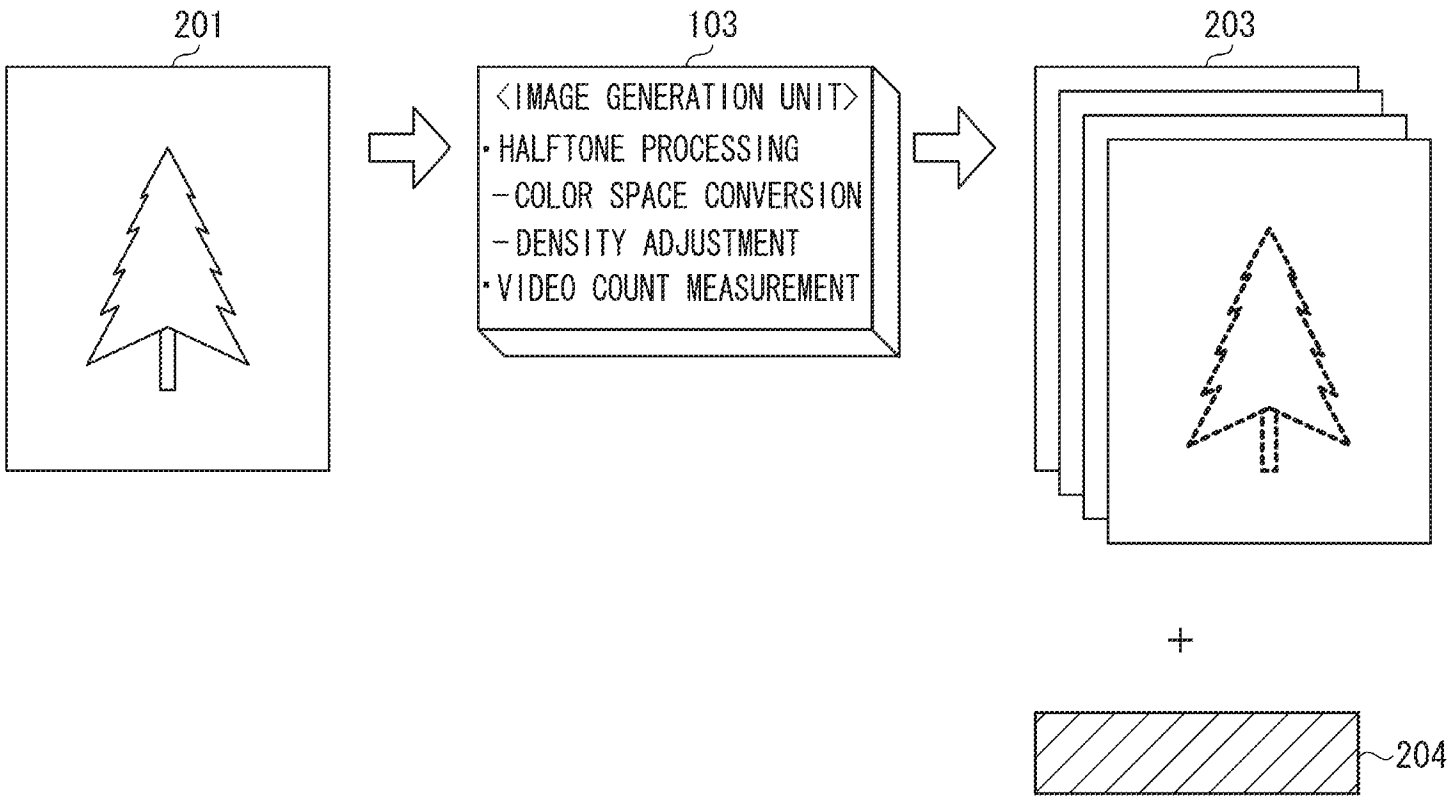
FIG. 2 illustrates an example of video count measurement when generating a halftone-processed image.

FIG. 2 illustrates an example of video count measurement performed to generate a halftone-processed image. Referring to FIG. 2, an input image 201 is a multi-valued image in an RGB format input from the external device connection unit 102 or the reading unit 105. The image generation unit 103 performs color space conversion and density adjustment on the input image 201 and performs halftone processing for generating a binary image. Further, the image generation unit 103 performs measurement of the video count value. Binary images 203 are image data on which halftone processing has been performed by the image generation unit 103 and include binary images for each of Y, M, C, and K.

When performing image combination, the image processing apparatus 101 combines a composite image 204, i.e., the binary image generated in the image processing apparatus 101, with the binary image 203. According to the present exemplary embodiment, the composite image 204 is the binary image of color K. However, the image processing apparatus 101 may generate the binary image for each color to be combined with the binary images 203.

FIGS. 3A-1, 3A-2, 3B, and 3C illustrate more concrete examples of image combination performed by the image processing apparatus 101.

Figures 1, 3A:
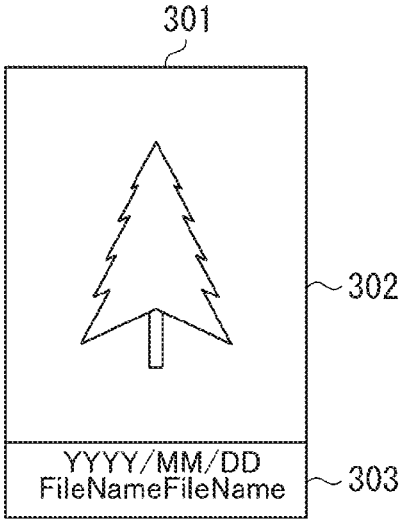
Figures 2, 3A:
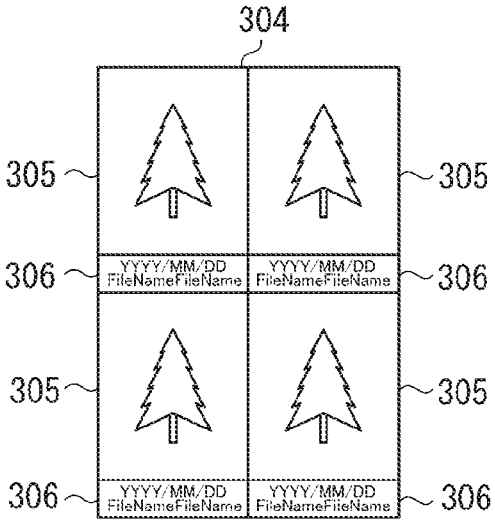

FIGS. 3A-1 and 3A-2 illustrate print images obtained by directly printing from a medium (i.e., performing media direct print). The media direct print is a function of inputting an image file stored in a portable medium, such as a USB memory, from the external device connection unit 103 and execute printing of the image. A time stamp and a file name of the image file can be added to the image when printing is executed by the media direct print. Further, layout printing, i.e., printing a plurality of pages on one sheet, can be performed in the media direct print.

FIG. 3A-1 illustrates a print image (of a single page) obtained by performing the media direct print.

Referring to FIG. 3A-1, a print image 301 is an image of a single page to which a time stamp and a file name are added, and includes an input image 302 and a composite image 303. The input image 302 is an image input from the external device connection unit 102 and halftone-processed by the image generation unit 103. The composite image 303 is an image generated inside the image processing apparatus 101 based on the time stamp and the file name of the image file.

FIG. 3A-2 illustrates a print image (in which a plurality of pages is laid out) obtained by performing the media direct print.

Referring to FIG. 3A-2, a print image 304 is an image obtained by performing layout printing of a plurality of pages and adding a time stamp and a file name to each page, and includes input images 305 and composite images 306. The input images 305 are images input from the external device connection unit 102 and halftone-processed by the image generation unit 103. The input images 305 are arranged in the print image 304 according to the number of pages. The composite images 306 are images generated inside the image processing apparatus 101 based on the time stamp and the file name of the image file. The composite images 306 are arranged in the print image 304 for each corresponding input image 305, according to the number of pages.

Figure 3B:
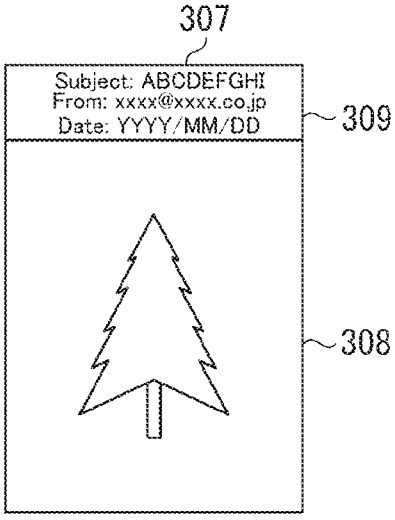

FIG. 3B illustrates a print image obtained by printing the data received by Internet facsimile (IFAX) or E-mail (i.e., IFAX/E-mail reception print).

The IFAX reception print and E-mail reception print are functions of receiving image data and text data from the external device connection unit 102 via the LAN and printing the data. The image processing apparatus 101 prints the image data with the text data. Examples of the text data are a title, a sender name, and transmission date and time of the received data.

A print image 307 is the image obtained by adding the text data to the received image data and includes an input image 308 and a composite image 309. The input image 308 is an image obtained by the image generation unit 103 performing halftone processing on the image data received from the external device connection unit 102. The composite image 309 is an image generated inside the image processing apparatus 101 based on the text data received from the external device connection unit 102.

Figure 3C:
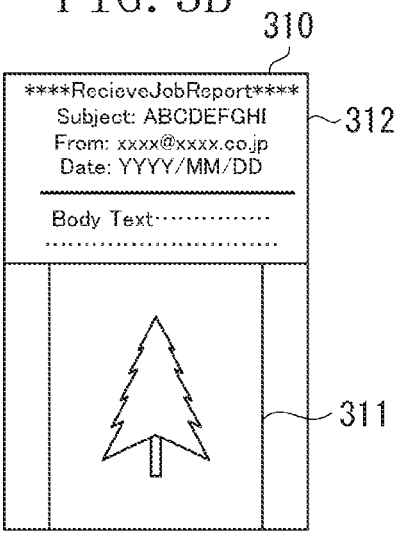

FIG. 3C illustrates a print image obtained by printing a report on IFAX/E-mail reception (i.e., performing report print).

The IFAX or E-mail reception printing includes a function of performing report print, i.e., notifying of a reception result, along with the function of printing the received image data with the text data. The report print function prints an image by adding the text data and information indicating the reception result thereto. Examples of the information indicating the reception result are a report title, a reception number, a communication time, the number of pages, and whether the reception is successful or failed (i.e., OK/NG).

A print image 310 is an image generated from the received data, to which the text data and the information indicating the reception result are added, and includes an input image 311 and a composite image 312. The input image 311 is an image obtained by the image generation unit 103 performing halftone processing on the image data received from the external device connection unit 102. The composite image 312 is an image generated inside the image processing apparatus 101 based on the text data received from the external device connection unit 102 and the information indicating the reception result.

Figure 4:
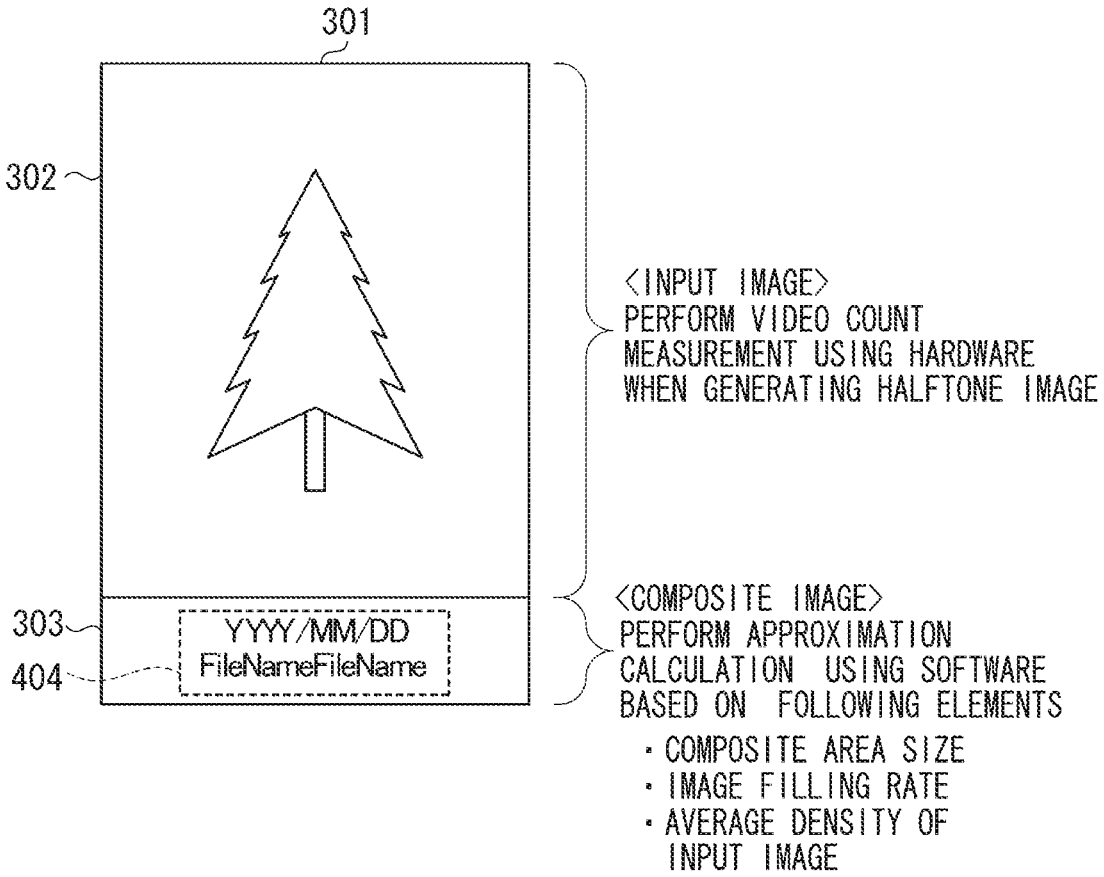
FIG. 4 illustrates a method for calculating the video count of the composite image by performing approximation calculation.

FIG. 4 illustrates a method for calculating the video count of the composite image by performing approximation calculation, using the print image obtained by the media direct print as an example.

Referring to FIG. 4, the image generation unit 103 measures the video count value of the input image 302 using hardware, when performing halftone processing. The software, which is realized by the CPU 107 executing processes based on a program, performs approximation calculation of the video count value of the composite image 303 employing the following equation (1):

Video count value of the composite image 303[integration of density values]=composite area size [number of pixels]×image filling rate×(maximum density value−average density value)[density value] equation (1)

The composite area size is a composite area size 404 illustrated in FIG. 4. More specifically, the composite area size is the number of pixels (a number obtained by multiplying a number of vertical pixels by a number of horizontal pixels) of the entire area in which the text corresponding to the time stamp and the file name is written. The image filling rate indicates a percentage of the number of chromatic color pixels in the composite area size 404. A detailed setting example will be described below with reference to FIG. 5. The average density value is a value of the input image 302, which is obtained by dividing the video count value of the input image 302 by the number of pixels in the entire area of the print image 301. The maximum density value is a maximum density value obtained when the image processing apparatus 101 performs printing, for example, 255.

The above-described equation (1) is formulated considering the case in which, when the original input image 302 exists in a background where the composite image 303 is combined, only a text portion of the composite image 303 is overwritten on the input image 302. Such portion corresponds to the difference between the maximum density value and the average density value.

The approximation calculation may be performed using the following equation (2), instead of equation (1):

Video count value of the composite image 303[integration of density values]=composite area size [number of pixels]×image filling rate×maximum density value [density value] equation (2)

Equation (2) is formulated considering the case where the original input image 302 does not exist in the background where the composite image 303 is combined, or the composite image 303 is entirely overwritten on the input image 302.

FIG. 5 illustrates setting example of the image filling rates.

Referring to FIG. 5, the case where the composite image is text data will be described below. The image filling rate is determined by a combination of a type of text and notation of the text. Examples of the type of text are a date and time such as the time stamp and the transmission date and time, and a character string such as a file name, a title and a sender name of the received data. The notation of the text with respect to the date and time uses numerals, so that the image filling rate corresponding to the numerals is set. The notation of the text with respect to the character string is categorized into alphabet, Chinese characters used in Japanese and Chinese languages, and other binary characters (e.g., kana characters in the Japanese Language and the characters in Korean language). The image filling rate corresponding to each notation is thus set.

The CPU 107 may also set or change the image filling rate according to a user operation via the operation unit 106.

FIG. 6 is a flowchart illustrating an example of information processing performed by the image processing apparatus 101. The print image obtained by performing the media direct print as illustrated in FIG. 3A-1 will be described as an example.

In step S601, the CPU 107 receives an image file as the input image 302 from the external device connection unit 102 and an execution instruction from the operation unit 106 for printing the input image 302. The execution instruction includes the information about whether to execute printing with the time stamp and the file name of the image file added.

In step S602, the CPU 107 transmits the received input image 302 to the image generation unit 103 and instructs it to perform halftone processing. The image generation unit 103 then generates the binary image of the input image 302 according to the instruction.

In step S603, the CPU 107 instructs the image generation unit 103 to measure the video count value of the input image 302. The image generation unit 103 thus measures the video count value of the input image 302 according to the instruction.

The video count value measured in step S603 is expressed by the following equations:

$$\mathrm{Vy_input} = \sum_{i=1}^{N} Dy(i)$$

$$\mathrm{Vm_input} = \sum_{i=1}^{N} Dm(i)$$

$$\mathrm{Vc_input} = \sum_{i=1}^{N} Dc(i)$$

$$\mathrm{Vk_input} = \sum_{i=1}^{N} Dk(i)$$

wherein Vy_input [density value] is the video count value of the binary image of the input image 302 for a yellow color component (Y); Vm_input [density value] is the video count value of the binary image of the input image 302 for a magenta color component (M); Vc_input [density value] is the video count value of the binary image of the input image 302 for a cyan color component (C); Vk_input [density value] is the video count value of the binary image of the input image 302 for a black color component (K); Dy (i) [density value] is the density value of each pixel in the binary image of the input image 302 for Y; Dm (i) [density value] is the density value of each pixel in the binary image of the input image 302 for M; Dc (i) [density value] is the density value of each pixel in the binary image of the input image 302 for C; Dk (i) [density value] is the density value of each pixel in the binary image of the input image 302 for K; and N [number of pixels] is the number of pixels in the input image 302.

In step S604, the CPU 107 determines whether to perform image combination based on the instruction received in step S601. If the CPU 107 determines to perform image combination (YES in step S604), the process proceeds to step S605. If the CPU 107 determines not to perform image combination (NO in step S604), the process proceeds to step S609. In step S605, the CPU 107 generates the composite image 303 based on the time stamp and the file name of the image file. In step S606, the CPU 107 performs approximation calculation of the video count value of the generated composite image 303.

The CPU 107 performs approximation calculation in step S606 using equation (1) described above with reference to FIG. 4.

The video count value calculated in step S606 is expressed by the following equation and corresponds to equation (1) described above with reference to FIG. 4:

$$Vk_comp = CompImageSize * ImageFillingRate\ (MaxDensity - Average\ Density)$$
$$AverageDensity = Vk_input / (InputImageSize + CompImageSize)$$

wherein Vk_comp [density value] is the video count value of the composite image 303 for K; CompImageSize [number of pixels] is the number of pixels in the composite image 303 for K; ImageFillingRate is the image filling rate of the composite image 303 for K; MaxDensity [density value] is the maximum density value obtained when the image processing apparatus 101 performs printing; AverageDensity [density value] is the average density value of the input image 302 for K; and InputImageSize [number of pixels] is the number of pixels of the input image 302.

In step S607, the CPU 107 adds the composite image 303 generated in step S605 to the binary image of the input image 302 generated in step S602 and performs image combination. In step S608, the CPU 107 adds the video count value of the composite image 303 obtained by performing approximation calculation in step S606 to the video cont value of the input image 302 measured in step S603.

The final video cont values obtained in step S608 are expressed by the following equations:

$$Vy_final = Vy_input$$

$$Vm_final = Vm_input$$

$$Vc_final = Vc_input$$

$$Vk_final = Vk_input + Vk_comp$$

wherein Vy_final is the video count value obtained by combining the input image 302 and the composite image 303 for Y; Vm_final is the video count value obtained by combining the input image 302 and the composite image 303 for M; Vc_final is the video count value obtained by combining the input image 302 and the composite image 303 for C; and Vk_final is the video count value obtained by combining the input image 302 and the composite image 303 for K.

In step S609, the CPU 107 notifies the printing unit 104 of the video count values calculated in step S608. In step S610, the CPU 107 prints the image obtained by performing image combination in step S607 using the printing unit 104.

If the CPU 207 determines not to perform image combination in step S604, the process proceeds to step S609. In step S609, the CPU 107 notifies the printing unit 104 of the video count values of the input image measured in step S603. In step S610, the CPU 107 prints the image generated in step S602 using the printing unit 104.

Figure 7:
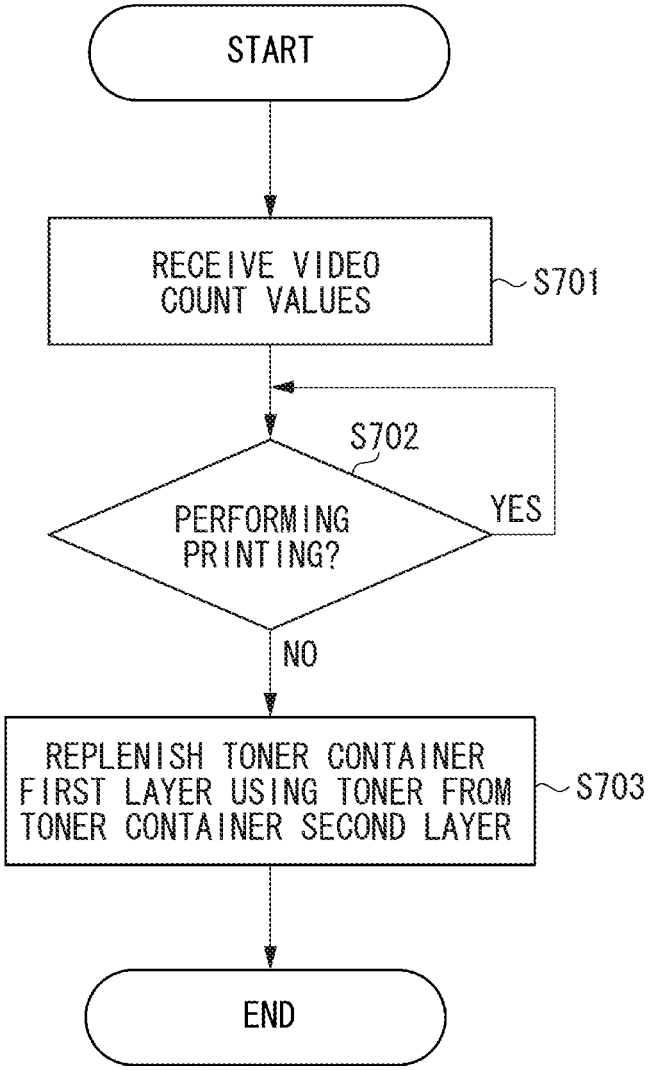
FIG. 7 is a flowchart illustrating an example of toner replenishment control using the video count value.

FIG. 7 is a flowchart illustrating an example of toner replenishment control based on the video count values. The process illustrated in the flowchart of FIG. 7 is performed by the printing unit 104 upon receiving the notification on the video count values in step S609.

In step S701, the printing unit 104 receives the video count values. In step S702, the printing unit 104 determines whether to perform a printing operation. If the printing operation is ended (NO in step S702), the process proceeds to step S703. In step S703, the printing unit 104 replenishes the toner container second layer 111 with an amount of toner corresponding to the video count value received in step S701, from the toner container first layer 110.

As described above, according to the present exemplary embodiment, when printing is performed by adding the image generated inside the image processing apparatus to the image input from the external device or the reading unit, the video count value of the composite image portion is calculated by performing approximation calculation. As a result, high speed printing is realized. Further, a load on the hardware of the printing unit is reduced, so that reliability can be improved.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like. Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-097913 filed May 9, 2014, which is hereby incorporated by reference herein in its entirety.

What is claimed is:

1. An image processing apparatus comprising:

a memory;

a controller that includes a circuit and a processor coupled to the memory and executes the following:

generating a composite image to be combined with an input image, wherein the input image is to be printed on a first area on a sheet and the composite image is to be printed on a second area on the sheet, and the first area and the second area are allocated separately on the sheet;

obtaining a value indicating a toner amount to be used in printing the input image;

determining, based on at least a size of the second area and a rate of the composite image area to the second area, a value indicating a toner amount to be used in printing the composite image generated;

calculating, based on the value indicating the toner amount to be used in printing the input image and the value indicating the toner amount to be used in printing the composite image, a value indicating a toner amount to be used in printing the input image with which the composite image has been combined; and notifying a printing unit of the value calculated.

2. The image processing apparatus according to claim 1, further comprising performing, based on the size of the second area, the rate of the composite image area, and density of the input image, approximation calculation of the value indicating the toner amount to be used in printing the composite image.

3. The image processing apparatus according to claim 1, further comprising calculating the toner amount to be used in printing the composite image based on the following equation:

toner amount to be used for printing the composite image=the size of the second area×the rate of the composite image area×(maximum density value−average density value of the input image).

4. The image processing apparatus according to claim 3, further comprising performing, using the rate of the composite image area set according to a type of the composite image, the calculation of the value indicating the toner amount to be used in printing the composite image.

5. The image processing apparatus according to claim 4, further comprising setting the rate of the composite image area.

6. The image processing apparatus according to claim 1, wherein the printing unit transfers toner based on the value calculated from a first toner containing space to a second toner containing space, a size of the first toner containing space being bigger than that of the second toner containing space.

7. An image processing method comprising:

generating a composite image to be combined with an input image, wherein the input image is to be printed on a first area on a sheet and the composite image is to be printed on a second area on the sheet, and the first area and the second area are allocated separately on the sheet;

obtaining a value indicating a toner amount to be used in printing the input image;

performing, based on at least a size of the second area and a rate of the composite image area to the second area, calculation of a value indicating a toner amount to be used in printing the composite image;

calculating, based on the value indicating the toner amount to be used in printing the input image and the value indicating the toner amount to be used in printing the composite image, a value indicating a toner amount to be used in printing the input image with which the composite image has been combined; and notifying a printing unit of the value indicating the toner amount to be used in printing the input image with which the composite image has been combined.

8. A printing apparatus comprising:

a memory;

a controller that includes a circuit and a processor coupled to the memory and executes the following:

generating a composite image to be combined with an input image, wherein the input image is to be printed on a first area on a sheet and the composite image is to be printed on a second area on the sheet, and the first area and the second area are allocated separately on the sheet;

determining, based on at least a size of the second area and a rate of the composite image to the second area, a value indicating a toner amount to be used in printing the composite image generated;

calculating, based on a value indicating the toner amount to be used in printing the input image and the value indicating the toner amount to be used in printing the composite image, a value indicating a toner amount to be used in printing the input image with which the composite image has been combined; and supplying toner to a printing unit, based on the value calculated.

9. The image processing apparatus according to claim 1, wherein the rate of the composite image area is a coefficient indicating the size of the second area.

10. The image processing apparatus according to claim 1, wherein a type of the composite image is one of a plurality of character types, the plurality of character types including at least alphabet and numeral.

11. The image processing apparatus according to claim 1, wherein the rate of the composite image area represents a percentage of a number of colored pixels in the second area.

12. The printing apparatus according to claim 8, wherein the rate of the composite image area is a coefficient indicating the size of the second area.

13. The printing apparatus according to claim 8, wherein a type of the composite image is one of a plurality of types of characters, the plurality of types including at least alphabet and numeral.

14. The printing apparatus according to claim 8, wherein the composite image area represents a percentage of a number of colored pixels in the second area.

15. The printing apparatus according to claim 1, wherein the first area and the second area are in contact.

16. An image processing apparatus comprising:

a counting unit that measures a video count value of an input image using hardware, the video count value being a value indicating a toner amount to be used in printing the input image;

a memory that stores a set of instructions; and at least one processor that executes the instructions to:

obtaining the video count value measured by the counting unit;

determining, based on at least a size of a second area on a sheet and a rate of a composite image area to the second area, a value indicating a toner amount to be used in printing a composite image, wherein the sheet includes a first area and the second area, the input image is printed on the first area, and the composite image is printed on the second area;

determining, based on the video count value measured by the counting unit using the hardware and the value indicating the toner amount to be used in printing the composite image determined by the at least one processor executing the instructions in the memory, a value indicating a toner amount to be used in printing the input image with which the composite image has been combined; and notifying a printing unit of the value calculated.

* * * * *